US007748702B2

(12) United States Patent
Auer et al.

(10) Patent No.: US 7,748,702 B2
(45) Date of Patent: Jul. 6, 2010

(54) METHOD AND DEVICE FOR COMBINING AUXILIARY AND MAIN STACKS IN A DELIVERY OR FEEDER OF A MACHINE FOR PROCESSING PRINTING MATERIALS AND SHEET-FED OFFSET PRINTING PRESS HAVING THE DEVICE

(75) Inventors: Klaus Auer, Hockenheim (DE); Michael Bantlin, Wiesloch (DE); Uwe Peters, Neckargemü nd (DE); Rolf Spilger, Viernheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 181 days.

(21) Appl. No.: 11/589,271

(22) Filed: Oct. 26, 2006

(65) Prior Publication Data

US 2007/0096388 A1 May 3, 2007

(30) Foreign Application Priority Data

Oct. 26, 2005 (DE) ..... 10 2005 051 301

(51) Int. Cl.

| | |
|---|---|
| ***B65H 1/26*** | (2006.01) |
| ***B65H 1/30*** | (2006.01) |
| ***B65H 3/00*** | (2006.01) |
| ***B65G 59/00*** | (2006.01) |

(52) U.S. Cl. ..... 271/159; 271/158; 271/157; 414/795.8

(58) Field of Classification Search ..... 271/3.04, 271/157, 158, 159; 414/795.8, 789.9, 790.8, 414/791, 790, 791.2, 791.4, 791.6, 791.9, 414/792, 802; 700/213–244

See application file for complete search history.

(56) References Cited

U.S. PATENT DOCUMENTS

| | | | | |
|---|---|---|---|---|
| 4,796,879 | A * | 1/1989 | Martini et al. | 271/218 |
| 5,096,372 | A * | 3/1992 | Maejima | 414/796.7 |
| 5,116,041 | A * | 5/1992 | Pollich | 271/158 |
| 5,295,681 | A * | 3/1994 | Blaser | 271/241 |
| 5,303,911 | A * | 4/1994 | Zahn et al. | 271/158 |
| 5,529,456 | A * | 6/1996 | Luxem et al. | 414/795.8 |
| 5,695,313 | A * | 12/1997 | Gross et al. | 414/793.4 |
| 6,196,542 | B1 * | 3/2001 | Allmendinger | 271/189 |
| 6,481,952 | B2 * | 11/2002 | Deutschle et al. | 414/790.8 |
| 2002/0150462 | A1 | 10/2002 | Furthmuller | |
| 2006/0244201 | A1 * | 11/2006 | Diem et al. | 271/145 |

FOREIGN PATENT DOCUMENTS

DE 29 35 710 A1 3/1980

(Continued)

*Primary Examiner*—Patrick Mackey
*Assistant Examiner*—Patrick Cicchino
(74) *Attorney, Agent, or Firm*—Laurence A Greenberg; Werner H Stemer; Ralph E. Locher

(57) ABSTRACT

A method and a device combine auxiliary and main stacks in a delivery or feeder of a machine for processing printing materials. The device includes a rake that can be moved in and out between the main and auxiliary stacks by a motor drive. A control computer controls the motor drive of the rake. Different speed profiles are stored in the control computer for the drive of the rake as a function of the printing materials in the stacks. A sheet-fed offset printing press having the device is also provided.

13 Claims, 3 Drawing Sheets

FOREIGN PATENT DOCUMENTS

| | | | |
|---|---|---|---|
| DE | 41 29 165 | A1 | 3/1993 |
| DE | 41 31 014 | A1 | 3/1993 |
| DE | 42 03 500 | C2 | 8/1993 |
| DE | 195 26 594 | A1 | 1/1997 |
| DE | 199 53 018 | A1 | 5/2001 |
| DE | 102 44 698 | A1 | 4/2004 |
| DE | 20 2004 017 813 | U1 | 2/2005 |
| EP | 0 974 543 | A1 | 1/2000 |
| EP | 1 081 072 | A2 | 3/2001 |
| EP | 1 251 093 | A2 | 10/2002 |

* cited by examiner

METHOD AND DEVICE FOR COMBINING AUXILIARY AND MAIN STACKS IN A DELIVERY OR FEEDER OF A MACHINE FOR PROCESSING PRINTING MATERIALS AND SHEET-FED OFFSET PRINTING PRESS HAVING THE DEVICE

CROSS-REFERENCE TO RELATED APPLICATION

This application claims the priority, under 35 U.S.C. §119, of German Patent Application DE 10 2005 051 301.8, filed Oct. 26, 2005; the prior application is herewith incorporated by reference in its entirety.

BACKGROUND OF THE INVENTION

1. Field of the Invention

The present invention relates to a method and a device for combining auxiliary and main stacks in a delivery or feeder of a machine for processing printing materials, having a motor driven rake that can be moved in and out between the auxiliary and main stacks and having a control computer for controlling driving of the rake. The invention also relates to a sheet-fed offset printing press having the device.

The delivery and the feeder are important constituent parts of sheet-fed offset printing presses. While the feeder is used to supply new printing materials, the delivery accepts sheets printed in the printing press and stacks them on one another. Both in the feeder and in the delivery, the stack has to be changed from time to time since, after a certain amount of time, the stacked sheets in the feeder have been used up, while in the delivery, after a certain amount of time, there is no longer any space for new printed sheets. The changing of the stack in the feeder or delivery of a sheet-fed offset printing press can be carried out by the press being switched off and in each case the stack in the feeder and delivery being removed and a new one introduced. However, since a stoppage of the press is uneconomical, what is known as nonstop operation has become widespread, both in the feeder and in the delivery in sheet-fed printing presses. During nonstop operation, the changing and introduction of a new stack in the feeder or delivery takes place with the press running, which requires appropriate technical measures. During nonstop operation, there are aids in the feeder and in the delivery which make it possible to handle two stacks simultaneously. To that end, for example in the feeder, when the sheet printing materials are disappearing, a rake is moved in under the small residual stack and lifts the residual stack off the actual stack carrying board. The printing materials on the rake are generally designated as an auxiliary stack. Since, in that case, the residual printing materials rest on the rake and no longer on the stack carrying board, the stack carrying board can be moved downward and can accept a new stack. When a new stack has been introduced on the stack carrying board, that new stack, which is also designated as a main stack, has to be combined with the residual stack continuing to shrink continuously on the rake. That combining of the main stack and the auxiliary stack is done by the rake under the auxiliary stack being pulled out again, so that the sheet printing materials of the auxiliary stack are deposited on the main stack. Such combining must proceed as gently as possible in order to ensure that the printing materials are not damaged.

A similar method in nonstop operation is applied in the delivery, but in the opposite order, in that, with a full main stack, first of all a rake is introduced above the main stack and, for a short time period, intercepts further printed sheets. The main stack underneath the rake can then be removed from the delivery and, instead, an empty pallet can be moved in. Following the introduction of the empty pallet into the delivery, that empty pallet is moved up and positioned under the rake, so that the auxiliary stack in the delivery can be deposited on the empty pallet. Following the removal of the rake under the auxiliary stack, the delivery continues to operate as before and accepts the finished printed sheets. Devices for automatic stack change in nonstop sheet feeders or deliveries are basically known. Such a nonstop device is known, for example, from German Utility Model DE 20 2004 017 813 U1. In that case, the nonstop device operates semiautomatically, since in that case the action of pulling out the supporting rods between the main stack and the auxiliary stack is performed through the use of a motor, while the action of pushing in the supporting rods must continue to be carried out manually. That semiautomatic embodiment is more economical than a fully automatic embodiment, since in that case only a pulling device for the supporting rods of the rake have to be provided but no thrust drive in order to be able to position the rake under the auxiliary stack. However, since such a semiautomatic nonstop device continues to need manual intervention, it is not suitable for fully automatic nonstop operation on the feeder or delivery of a sheet-fed printing press. In addition, there is also the risk of operating personnel damaging sheets when pushing the supporting rods under the auxiliary stack of the feeder, since the pushing in action can take place only by utilizing the sense of touch of the operating personnel. German Published, Non-Prosecuted Patent Application DE 41 29 165 A1, corresponding to U.S. Pat. No. 5.529,456, discloses a device for combining a residual sheet stack and a main sheet stack in a nonstop feeder. In that case, during the combining of the residual sheet stack with the main sheet stack to form an overall stack, a rake is pushed in through the use of a drive motor. The rake and its lattice bars have a specific cross section at its free rod ends, in order to prevent the residual sheet stack from sagging during combining. That is intended to permit fault-free combining of the main and auxiliary stacks in the feeder. However, since an extremely wide range of materials can be processed in sheet-fed printing presses, in the case of a fully automatic embodiment, the same procedure of automatic pushing in and pulling out of the rake is currently carried out. In that case, markings can occur on sheets, which then have to be removed from the stack as rejects.

SUMMARY OF THE INVENTION

It is accordingly an object of the invention to provide a method and a device for combining auxiliary and main stacks in a delivery or feeder of a machine for processing printing materials and a sheet-fed offset printing press having the device, which overcome the hereinafore-mentioned disadvantages of the heretofore-known devices and methods of this general type, without the printing materials encountered by the rake moving in and out being damaged on the surface.

With the foregoing and other objects in view there is provided, in accordance with the invention, in a delivery or feeder of a machine for processing printing materials, a device for combining an auxiliary stack and a main stack. The device comprises a rake, a motor drive for moving the rake in and out between the main stack and the auxiliary stack, and a control computer for controlling the motor drive for the rake. The control computer stores different speed profiles for driving the rake as a function of the printing materials in the stacks.

In a delivery or feeder of a machine for processing printing material according to the invention, the combining of the main stack and the auxiliary stack is performed fully automatically. This means that the action of moving in and pulling out the rake between the auxiliary stack and the main stack is carried out through the use of a drive motor which actuates the rake. In this case, the drive motor is connected to a control computer and it is possible for it to be a separate control computer or the control computer of the machine processing the printing material. Through the use of the control computer, it is possible to control the speed of the rake as it is moved in or out of the main and auxiliary stacks. However, the movement of the rake should be carried out at different speeds, depending on the nature of the printing materials stacked in the feeder or delivery. In addition, the speed when pulling out or moving in the rake between the main and auxiliary stacks is not necessarily constant but can vary, depending on the state of the movement. It is only if the speed when moving in or out of the main and auxiliary stacks is controlled optimally that the printing materials will be damaged as little as possible. To this end, different speed profiles for the driving of the movable rake are stored in the control computer, each of which takes into account the properties of the printing material in the stack. For example, different speed profiles are stored for stacks of board than those for stacks of paper. Thus, for each printing material, the optimal movement sequence can be set when moving the rake in or out between the main and auxiliary stacks.

In addition, there can be a sensor in the delivery or feeder, which registers the surface of the printing materials to be processed and thus automatically determines the properties of the printing materials. The appropriate speed profile for driving the rake can then be selected automatically in the control computer by using the registered printing materials. Alternatively or additionally, possibilities can also be provided for the quality of the printing material being used to be transmitted to the control computer through an input device. In this case, the operating personnel enter the nature of the printing material used by hand or select the printing material to be processed from a large number of printing materials stored in the control computer. The appropriate speed profile in the control computer is then selected on the basis of this selection. This ensures that the properties of the printing material to be processed in each case are taken into account optimally.

In accordance with another feature of the invention, the speed profiles of the drive for the rake are stored on the basis of the shape of the rods of the rake. In addition to taking into account the properties of the printing materials to be processed, the shape of the rake rods can also be taken into account in the speed profiles. The shape of the rake being used is important inasmuch as the speed with which the rake is moved in and out between the main and the auxiliary stack also depends thereon. For instance, if a different rake is used, then the speed previously had to be adapted manually. According to the present invention, the shape of the rake being used can either be registered by a corresponding sensor on the feeder or delivery on the basis of a code present in the rake, or the rake being used is conveyed to the control computer by the operating personnel.

In accordance with a further feature of the invention, speed profiles for the operation of a suction head in the feeder as a function of the printing materials being used are stored in the control computer. Sheet after sheet is removed from the stack and fed to the first printing unit of a press or another machine, for example a folding machine, by using the suction head in the feeder. Lifting the sheets off the feed stack likewise depends on the nature of the printing material, since the latter can differ considerably in weight. If the property of the printing material being used is also taken into account appropriately for the driving of the suction head, the performance of the feeder is improved further. Since the properties of the printing materials being used for controlling the rake during the nonstop change are present in the control computer in any case, these can likewise be used for driving the suction head. The registration or input of the printing materials being used can be carried out in the same way as in the control of the motor-operated rake.

In accordance with an added feature of the invention, a sensor is provided for measuring the load of the auxiliary stack. The combining of the main and auxiliary stacks can be controlled all the more precisely the more that is known about the properties of the auxiliary stack. The combining of the main and auxiliary stacks is carried out particularly carefully if the rake is loaded as little as possible as it is pulled out between the main and auxiliary stacks. Otherwise, as a result of a high loading of the supporting rods of the rake, there is the risk that markings would occur on the sheets.

In accordance with an additional feature of the invention, the combining of the main and auxiliary stacks is carried out on the basis of the measured load of the auxiliary stack. If the load of the auxiliary stack is registered continuously, the speed when pushing the rake in or out can also be controlled in accordance with the loading of the auxiliary stack. In the case of a low load, the pulling of the rake can, for example, be carried out at a higher speed than in the case of a high load.

In accordance with yet another feature of the invention, the optimum starting position for the combining of the main stack and the auxiliary stack is calculated by using the data from the printing material being used or the operating speed of the machine processing the printing materials or further operating parameters of the machine or feeder. In this refinement of the invention, the starting time for the combining of the auxiliary stack and the main stack can be optimized by influences from other processes in the feeder or of the downstream printing press also being taken into account. For instance, the combining of the main stack and the auxiliary stack on the feeder can be performed when the suction head is just not touching the auxiliary stack as the sheets are lifted off the auxiliary stack, so that the suction head has no influence on the auxiliary stack.

With the objects of the invention in view, there is also provided a sheet-fed offset printing press, comprising a delivery or feeder having a device for combining an auxiliary stack and a main stack. The device includes a rake, a motor drive for moving the rake in and out between the main stack and the auxiliary stack, and a control computer for controlling the motor drive for the rake. The control computer stores different speed profiles for driving the rake as a function of the printing materials in the stacks.

With the objects of the invention in view, there is additionally provided a method of operating a device for combining an auxiliary stack and a main stack in a delivery or feeder of a machine for processing printing materials. The method comprises moving a rake in and out between the main stack and the auxiliary stack with a motor drive. The motor drive for the rake is controlled with a control computer storing different speed profiles for driving the rake as a function of the printing materials in the stacks. A load of the auxiliary stack is continually registered during combining of the main stack and the auxiliary stack. An action of pulling out the rake is interrupted upon increasing loading by the auxiliary stack.

The load of the auxiliary stack can be registered continually through the use of the load sensor, so that the pressure of the auxiliary stack on the main stack, and therefore also on the rake, can be monitored continuously. If the pressure as the rake is pulled out becomes too high, then this process can be interrupted, so that the sheets lying underneath are not damaged. If the loading falls below a predefined value again, then the process of pulling the rake out can be continued.

In accordance with another mode of the invention, the main stack and the auxiliary stack are moved synchronously if the load measurement of the auxiliary stack falls below a specific value. This specific value defines when the main and auxiliary stacks are combined with each other. If the loading value lies at a specific limit, then it is assumed that the main and auxiliary stacks are touching only slightly and thus there are actually two stacks. In order to ensure that no gap arises between the main and auxiliary stacks, the main and auxiliary stacks are moved synchronously in such a situation. If the loading of the auxiliary stack increases, then the synchronous movement process is stopped and the main stack does not approach the auxiliary stack further. In this case, the main and auxiliary stacks are touching and the rake between main and auxiliary stack can be pulled out.

In accordance with a concomitant mode of the invention, if the load on the auxiliary stack falls below a predefined value, the rake between the auxiliary stack and the main stack is pulled out. The predefined value is determined in such a way that, although the main and auxiliary stacks touch, so that a synchronous movement of the main and auxiliary stacks is not absolutely necessary, on the other hand the load of the auxiliary stack is also not so high that pulling the rake out would damage the sheets located underneath and above the rake. This also ensures that, during the combining of the main and auxiliary stacks, an optimal result is achieved. The value can be different from or the same as the preceding embodiment during the synchronous movement and it is also possible for this to depend on the printing material.

Other features which are considered as characteristic for the invention are set forth in the appended claims.

Although the invention is illustrated and described herein as embodied in a method and a device for combining auxiliary and main stacks in a delivery or feeder of a machine for processing printing materials and a sheet-fed offset printing press having the device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
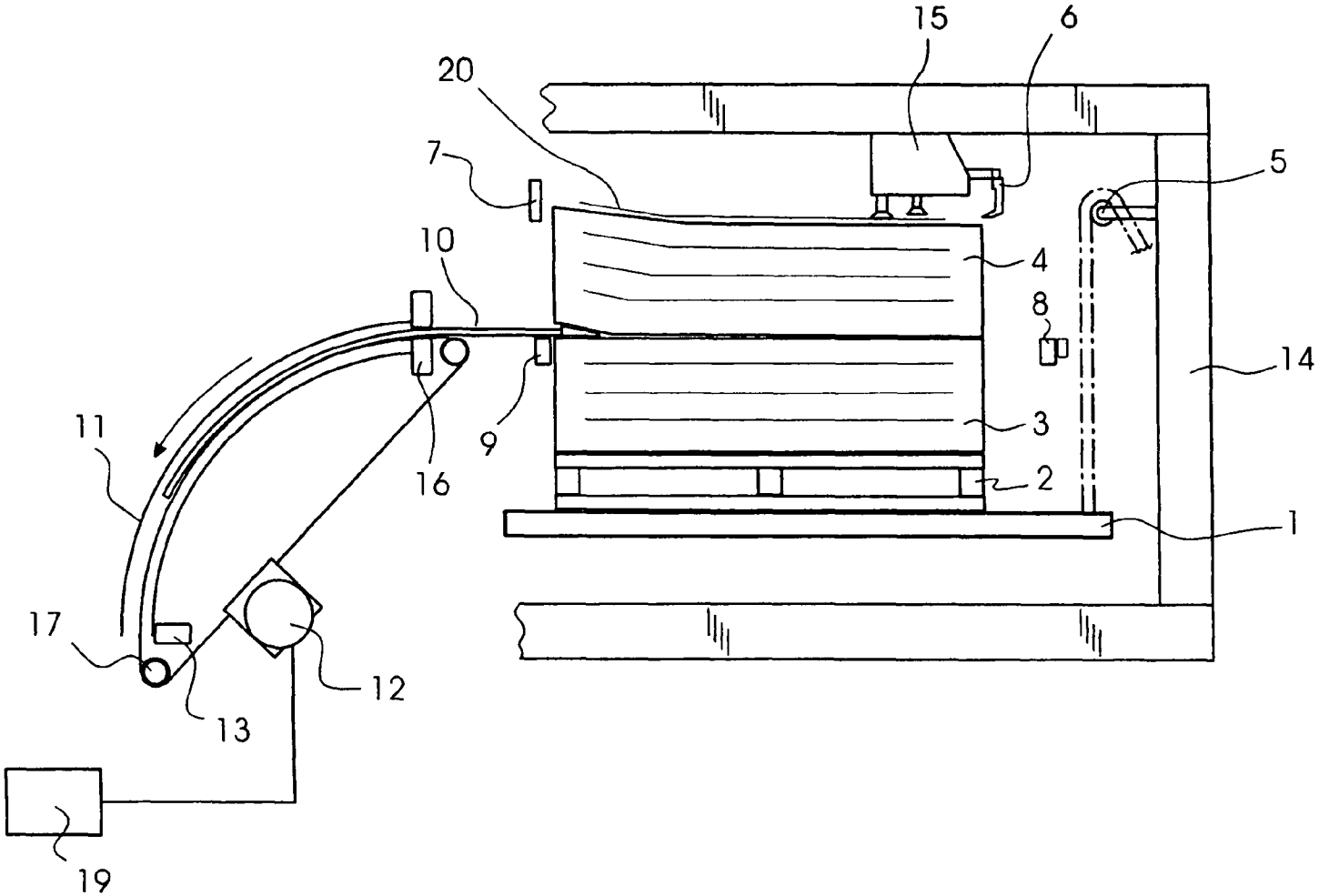
FIG. 1 is a diagrammatic, side-elevational view of a feeder for a sheet-fed printing press having a nonstop device according to the invention.
Figure 4:
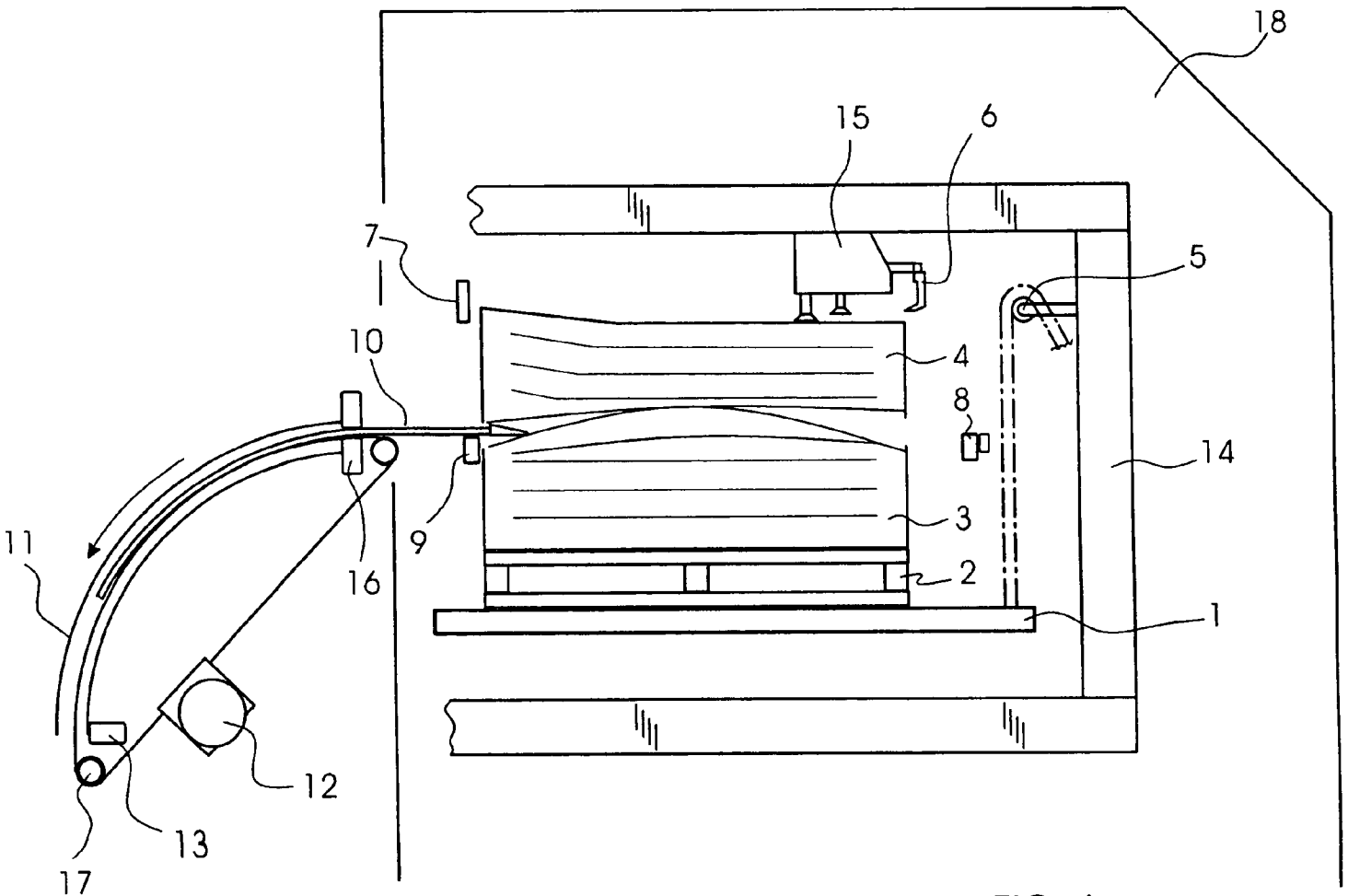
FIG. 4 is a side-elevational view of a feeder for a sheet-fed printing press with upwardly curved sheet material in the feeder.

Referring now to the figures of the drawings in detail and first, particularly, to FIG. 1 thereof, there is seen a feeder 14 which is normally used for feeding sheet printing materials 20 in sheet-fed offset printing presses 18 or machines for further print processing (see FIG. 4). The feeder 14 has an adjustable height stack carrying board 1, with which a pallet 2 can be positioned in the vertical direction. The sheet printing materials 20 are located on the pallet 2 in the form of a main stack 3. The pallet 2 together with the main stack 3 can be positioned vertically through the use of a drive 5 for the stack carrying board 1, so that an upper edge of the main stack 3 is always located in the region of a suction head 15 between two stack changes. The sheets 20 are lifted off the main stack 3 using the suction head 15, and fed to a first non-illustrated printing unit of the printing press.

In FIG. 1, the feeder 14 is shown in nonstop operation during combining of the stack 3 with a stack 4, that is to say a new main stack 3 has just been supplied, while an old main stack is now present as a residual stack and therefore as an auxiliary stack 4. The main stack 3 is introduced with the stack carrying board 1 lowered, while the auxiliary stack 4 is held by a nonstop rake 10 in a moved-in state. In this state, the nonstop rake 10 rests on a rear nonstop rail 8, so that the auxiliary stack 4 cannot fall down. In a front region, the nonstop rake 10 is guided by a front nonstop rail 9. The nonstop rake 10 can primarily be moved horizontally and can be moved in and out between the main and auxiliary stacks 3, 4. In this case, the nonstop rake 10 in FIG. 1 includes movable elements and can thus be moved to the side in a guide track 11. The nonstop rake 10 is moved in and out through the use of a drive motor 12. The drive motor 12 is in turn linked to a control computer 19, which is either present in addition to a machine computer of the printing press or can be integrated in the machine computer of the printing press. An end position of the nonstop rake 10 when it is moved out is detected by a normally closed switch 13, which either acts directly on the drive motor 12 or acts on the drive motor 12 through the control computer 19.

In order to keep the upper edge of the stack in the region of the suction head 15, the suction head 15 has what is known as a sensing foot 6, with which the surface of the upper sheet 20 can be touched. In addition, the feeder 14 has an additional height sensor 7, which is constructed as a front stack edge sensor and is responsible for positioning the upper edge of the sheet 20 of the stack and controlling the stack carrying board 1. If there is no sheet 20 in the region of the height sensor 7 for the front stack edge, then the stack carrying board 1 is raised by the motor 5 until the upper edge of the sheet 20 is again located in the region of the height sensor 7. In each case the suction head 15 is lowered in the direction of the top sheet 20 until the sensing foot 6 reports contact with the sheet 20. If, as in FIG. 1, the previous main stack, which is now the auxiliary stack 4, is disappearing, in nonstop operation a new main stack 3 is introduced with the rake 10 moved in. The main stack is moved through the use of the stack carrying board 1 until its upper edge is under the nonstop rake 10. When the main stack touches the rake 10, the combining operation of auxiliary stack 4 and main stack 3 begins. For this purpose, the nonstop rake 10 between auxiliary stack 4 and main stack 3 is pulled out, which is done in the gentlest possible way, in order not to damage the sheets 20 of the two stacks 3, 4 or to change their position.

Figure 2:
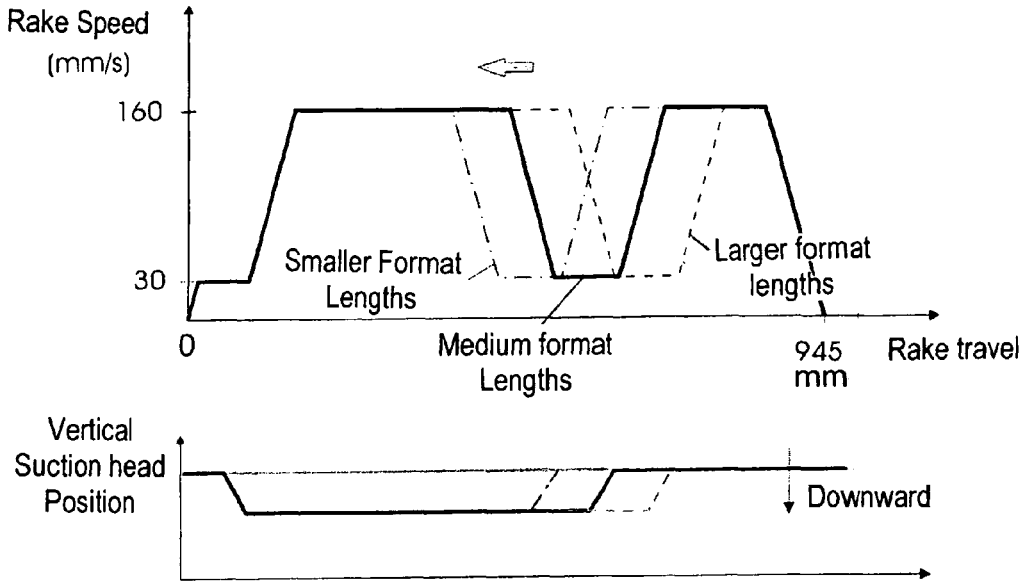
FIG. 2 is a speed graph recorded over an operating travel of a rake and a vertical suction head position as a function of a position of the rake.

According to FIG. 2, various speed profiles are stored in the control computer 19 as a function of the properties of the printing material 20. In the upper graph of FIG. 2, control of the rake speed as it is pulled out is carried out as a function of the format of the sheet 20 being used. It can be seen that a different speed profile is used in the case of smaller sheet formats than in the case of medium or greater formats. In addition to the format of the sheet 20, the control of the rake speed is also carried out as a function of the rake travel being covered. A position 0 mm of the rake travel identifies the rake 10 when it has been removed completely from the stack while, in a position 945 mm, it has been moved in completely between the auxiliary stack 4 and the main stack 3. It can be seen that, depending on the format of the sheet 20 being used and the travel being covered by the rake 10, there is a different speed of the rake which, in FIG. 2, fluctuates between 0 and 160 mm/s.

In addition, the vertical position of the suction head 15, which is also recorded in FIG. 2, is likewise varied as a function of the state of the rake 10. This ensures that, in specific positions of the rake as it is moved in and out, the suction head maintains a certain distance from the upper sheet 20. The change in the distance from the sheet 20 arises because, as the rake 10 is pulled out of the stack, the stacked sheets 20 give way by the diameter of the rake 10, since a space between the auxiliary stack 4 and the main stack 3 then becomes free.

Figure 3:
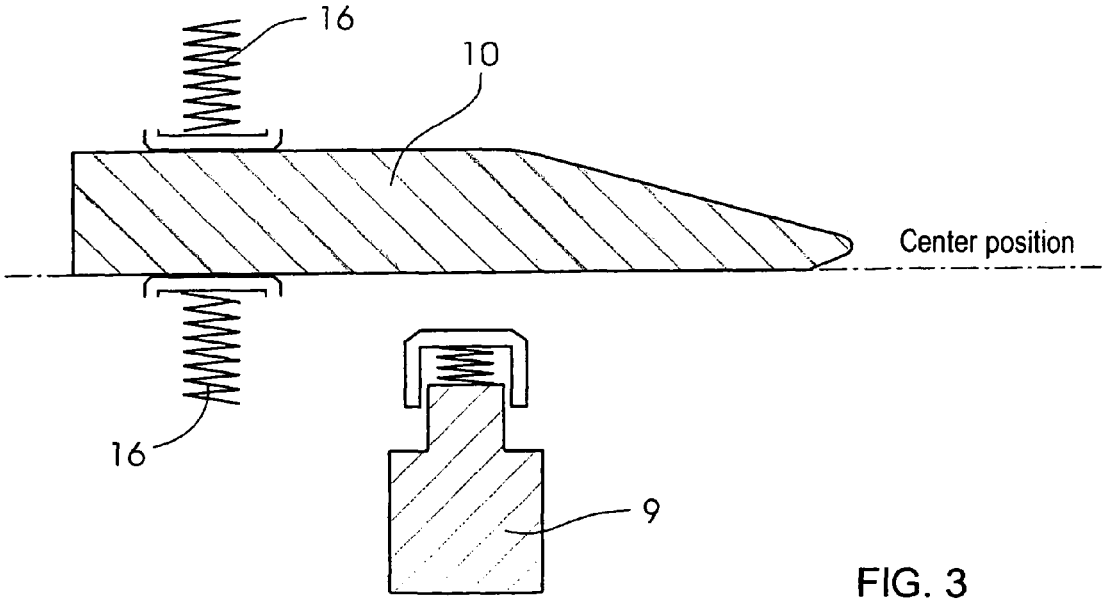
FIG. 3 is a partly-sectional view of an adjustable height guide for the nonstop rake.

FIG. 3 shows the tip of a rake rod of the rake 10, which can be pushed back and forth between two lateral guides 16. The nonstop rake 10 can be positioned vertically through the use of the guides 16. The rake can be lowered until it rests on the front nonstop rail 9. Further lowering beyond this position is not possible. The speed profiles for driving the rake 10 are stored on a basis of the shape of the rods.

The illustration in FIG. 4 is substantially identical to that in FIG. 1, but the sheet-fed printing press 18 which is supplied with the sheet printing material 20 by the feeder 14 is additionally diagrammatically shown in the background of the feeder 14. In contrast to FIG. 1, FIG. 4 additionally shows upwardly curved sheets between the main stack 3 and the auxiliary stack 4, which make it more difficult to pull the rake 10. As a result of the upwardly curved sheets 20, there is an increased risk that sheets will be damaged as the rake 10 is pulled out. In this case, the increased resistance on the nonstop rake 10 which is caused by the upwardly curved sheets 20 can be determined through the use of a loading sensor 17. The speed can then additionally be varied on the basis of the resistance determined by the sensor 17 as the nonstop rake 10 is pulled out. In this case, the speed profiles stored in the control computer 19 can have the values determined by the loading sensor 17 applied to them and can be varied accordingly. In this way, even in the case of upwardly curved sheets 20, it is ensured that damage is ruled out, for example, by pulling out the rake 10 more slowly.

With the present invention, it is possible to limit damage to the sheets 20 between the main stack 3 and the auxiliary stack 4 to a minimum, by taking the specific properties of the sheets 20 being used and the conditions, such as upwardly curved sheets 20, into account.

We claim:

1. In a delivery or feeder of a machine for processing printing materials, a device for combining an auxiliary stack and a main stack, said device comprising:

a rake;

a motor drive for moving said rake in a horizontal direction in and out between the main stack and the auxiliary stack; and a control computer for controlling said motor drive for said rake, said control computer storing different speed profiles for driving said rake in the horizontal direction as a function of properties of the printing materials in the stacks.

2. The device according to claim 1, wherein said rake has rods with a shape, and said speed profiles for driving said rake are stored on a basis of said shape of said rods.

3. The device according to claim 1, wherein the feeder has a suction head, and speed profiles for operation of the suction head as a function of the printing materials being used are stored in said control computer.

4. The device according to claim 1, which further comprises a sensor for measuring a load of the auxiliary stack.

5. The device according to claim 4, wherein said measured load of the auxiliary stack is used as a basis for combining the main and auxiliary stacks.

6. The device according to claim 4, wherein said rake is pulled out from between the auxiliary stack and the main stack at a speed controlled as a function of a registered load of the auxiliary stack.

7. The device according to claim 1, wherein an optimum starting position for combining the main stack and the auxiliary stack is calculated by using data from the printing material being used.

8. The device according to claim 1, wherein an optimum starting position for combining the main stack and the auxiliary stack is calculated by using an operating speed of the machine processing the printing materials.

9. The device according to claim 1, wherein an optimum starting position for combining the main stack and the auxiliary stack is calculated by using further operating parameters of the machine or the feeder.

10. A sheet-fed offset printing press, comprising:

a delivery or feeder having a device for combining an auxiliary stack and a main stack, said device including:

a rake;

a motor drive for moving said rake in a horizontal direction in and out between the main stack and the auxiliary stack; and a control computer for controlling said motor drive for said rake, said control computer storing different speed profiles for driving said rake in the horizontal direction as a function of properties of the printing materials in the stacks.

11. A method of operating a device for combining an auxiliary stack and a main stack in a delivery or feeder of a machine for processing printing materials, the method comprising the following steps:

moving a rake in a horizontal direction in and out between the main stack and the auxiliary stack with a motor drive;

controlling the motor drive for the rake with a control computer storing different speed profiles for driving the rake in the horizontal direction as a function of properties of the printing materials in the stacks;

continually registering a load of the auxiliary stack during combining of the main stack and the auxiliary stack; and interrupting an action of pulling out the rake upon increasing loading by the auxiliary stack.

12. The method according to claim 11, which further comprises synchronously moving the main stack and the auxiliary stack if a load measurement of the auxiliary stack falls below a specific value.

13. The method according to claim 12, which further comprises pulling out the rake between the auxiliary stack and the main stack if the load on the auxiliary stack falls below a predefined value.

* * * * *